US009687975B2

(12) United States Patent
Dittrich

(10) Patent No.: US 9,687,975 B2
(45) Date of Patent: Jun. 27, 2017

(54) FASTENER DRIVING TOOL AND METHOD FOR OPERATING A FASTENER DRIVING TOOL

(75) Inventor: Tilo Dittrich, Feldkirch (AT)

(73) Assignee: Hilti Aktiengesellschaft, Schaan (LI)

( * ) Notice: Subject to any disclaimer, the term of this patent is extended or adjusted under 35 U.S.C. 154(b) by 416 days.

(21) Appl. No.: 13/326,053

(22) Filed: Dec. 14, 2011

(65) Prior Publication Data

US 2012/0153002 A1 Jun. 21, 2012

(30) Foreign Application Priority Data

Dec. 15, 2010 (DE) ..... 10 2010 063 177

(51) Int. Cl.
*B25C 1/00* (2006.01)
*B25C 1/08* (2006.01)
*B25C 1/06* (2006.01)

(52) U.S. Cl.
CPC ..... *B25C 1/08* (2013.01); *B25C 1/00* (2013.01); *B25C 1/06* (2013.01)

(58) Field of Classification Search
CPC .. B25C 1/06; B25C 1/008; B25C 1/08; B25C 1/04; B25C 1/00; B25C 1/042
USPC .... 227/2, 4, 7–10, 129–130; 173/2, 4–9, 11, 173/14–17, 90, 125, 128, 152, 200, 206, 173/208–209; 102/281, 466, 530–531; 123/46 SC, 48 R, 143 B
See application file for complete search history.

(56) References Cited

U.S. PATENT DOCUMENTS 4,377,991 A * 3/1983 Liesse ..... 123/46 SC
4,773,581 A * 9/1988 Ohtsu et al. ..... 227/10
5,181,495 A * 1/1993 Gschwend et al. ..... 123/46 SC
5,213,247 A * 5/1993 Gschwend et al. ..... 227/10
5,592,580 A * 1/1997 Doherty et al. ..... 388/815
5,752,643 A * 5/1998 MacVicar ..... B25C 1/08 227/10
6,260,519 B1 * 7/2001 Phillips ..... 123/46 R
6,318,615 B1 * 11/2001 Walter ..... 227/10
6,419,168 B1 * 7/2002 Thieleke et al. ..... 239/337
(Continued)

FOREIGN PATENT DOCUMENTS

DE 40 32 204 A1 4/1992
DE 199 62 598 A1 7/2001
(Continued)

OTHER PUBLICATIONS

German Search Report, dated Nov. 8, 2012, 6 pages total.
(Continued)

*Primary Examiner* — Andrew M Tecco
*Assistant Examiner* — Chelsea Stinson
(74) *Attorney, Agent, or Firm* — Crowell & Moring LLP

(57) ABSTRACT

A fastener driving tool and method for driving fasteners into a substrate is disclosed. The tool includes a working piston that is capable of being moved abruptly translationally by igniting an ignitable mixture in a combustion chamber so as to drive a fastener, such as a stud or a nail. The volume of the combustion chamber is adjustable. In order to further improve the operation and/or energy efficiency of the fastener driving tool, the fastener driving tool also includes a control device which is connected in a control relationship to an adjusting device for adjusting the combustion chamber volume and to a metering valve device for metering fuel gas.

13 Claims, 1 Drawing Sheet

(56) References Cited

U.S. PATENT DOCUMENTS

| | | | | |
|---|---|---|---|---|
| 6,425,354 | B1 * | 7/2002 | Buchel et al. | 123/46 R |
| 6,460,507 | B2 * | 10/2002 | Thieleke et al. | 123/260 |
| 6,463,894 | B2 * | 10/2002 | Hasler et al. | 123/46 R |
| 6,520,127 | B1 * | 2/2003 | Thieleke et al. | 123/46 R |
| 6,526,926 | B1 * | 3/2003 | Towfighi | 123/46 R |
| 6,739,490 | B1 * | 5/2004 | Shkolnikov | B25C 1/08 227/109 |
| 6,755,335 | B2 * | 6/2004 | Fielitz | 227/10 |
| 6,796,476 | B2 * | 9/2004 | Birk | B25C 1/08 227/10 |
| 6,892,524 | B1 * | 5/2005 | Van Erden et al. | 60/39.6 |
| 6,988,469 | B2 * | 1/2006 | Schiestl et al. | 123/46 SC |
| 7,284,510 | B2 * | 10/2007 | Schiestl et al. | 123/46 H |
| 7,918,374 | B2 * | 4/2011 | Gardner et al. | 227/130 |
| 8,267,298 | B2 * | 9/2012 | Zahner et al. | 227/10 |
| 2004/0182337 | A1 | 9/2004 | Schiestl et al. | |
| 2006/0054116 | A1 * | 3/2006 | Schiestl et al. | 123/46 H |
| 2006/0260310 | A1 * | 11/2006 | Toulouse et al. | 60/632 |
| 2008/0179371 | A1 | 7/2008 | Gardner et al. | |

FOREIGN PATENT DOCUMENTS

| | | | |
|---|---|---|---|
| DE | 199 62 695 | B4 | 7/2001 |
| DE | 19962711 | A1 * | 7/2001 |
| DE | 102 59 816 | A1 | 7/2004 |
| DE | 10 2005 000 032 | A1 | 10/2006 |
| EP | 1 093 888 | A2 | 4/2001 |
| EP | 1 844 904 | A1 | 10/2007 |

OTHER PUBLICATIONS

English Translation of Chinese Office Action dated Dec. 29, 2014 (Seven (7) pages).

European Search Report issued in counterpart application No. EP 11189461.4 dated Sep. 16, 2015, with Statement of Relevancy (Five (5) pages).

* cited by examiner

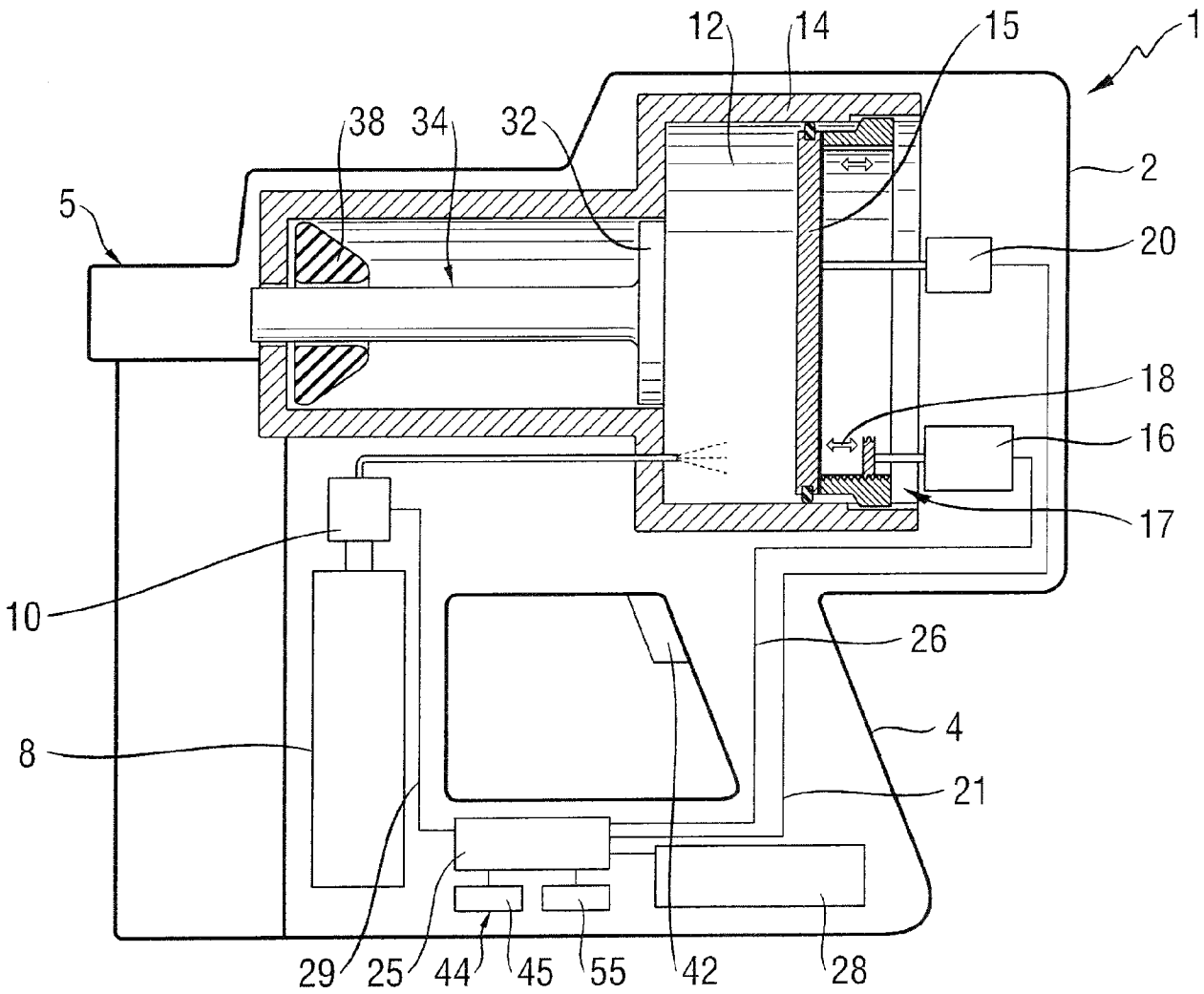
1
2
20
18
16
17
15
14
12
32
34
38
5
10
8
29
25
44
45
55
42
28
21
4
26

FASTENER DRIVING TOOL AND METHOD FOR OPERATING A FASTENER DRIVING TOOL

This application claims the priority of German Patent Document No. 10 2010 063 177.9, filed Dec. 15, 2010, the disclosure of which is expressly incorporated by reference herein.

BACKGROUND AND SUMMARY OF THE INVENTION

The invention relates to a fastener driving tool for driving fasteners into a substrate, having a working piston that is capable of being moved abruptly translationally by igniting an ignitable mixture in a combustion chamber so as to drive a fastener, such as a stud or a nail, the volume of the combustion chamber being adjustable. The invention further relates to a method for operating such a fastener driving tool.

From German Patent Document DE 199 62 695 B4, a portable combustion-operated fastener driving tool is known that has a combustion chamber for receiving a combustion fuel mixture, the size of the combustion chamber being changeable in order to adjust the fuel gas mixture present therein towards lean or rich by means of axial displacement of a front-side combustion chamber wall. From German published patent application DE 10 2005 000 032 A1, a combustion-operated fastener tool is known that has two partial chambers, between which a divider is arranged, in which passageways have an active opening cross section.

The aim of the invention is to further improve the operation and/or energy efficiency of a fastener driving tool.

This aim is achieved in a fastener driving tool for driving fasteners into a substrate, having a working piston that is capable of being moved abruptly translationally by igniting an ignitable mixture in a combustion chamber so as to drive a fastener, such as a stud or a nail, the volume of the combustion chamber being adjustable, in that the fastener driving tool comprises a control device which is connected in control relationship to an adjusting device for adjusting the combustion chamber volume and to a metering valve device for metering fuel gas. The fastener driving tool according to the invention is preferably a portable combustion-operated fastener driving tool. In order to drive a fastener, gas, for example from a gas cartridge, is mixed in the combustion chamber with oxygen or air to form an ignitable mixture. When the ignitable mixture is ignited, it then abruptly expands so as to drive the working piston. As a result of combining, according to the invention, the adjusting device with the metering valve device, the fastener driving tool is capable of operating over a wide energy range while at the same time enabling efficient energy use. The load on the fastener driving tool during operation is markedly reduced, in particular when fasteners are driven at minimum energy. As a result, the serviceable life of the fastener driving tool is extended.

A preferred embodiment of the fastener driving tool is characterized in that the adjusting device for adjusting the combustion chamber volume comprises a motor, in particular an electric motor. Particularly preferably, the combustion chamber volume is adjusted using a stepper motor. The motor is controlled by the control device.

Another preferred embodiment of the fastener driving tool is characterized in that the motor is linked by a gear mechanism to an adjustable combustion chamber wall. The gear mechanism is preferably designed such that a self-locking mechanism causes the same to stay in the current position thereof when under load from the combustion chamber pressure. Additionally, the gear mechanism is preferably designed such that the combustion chamber pressure does not act on the motor. The motor is mounted in the fastener driving tool preferably with the aid of dampening elements.

Another preferred embodiment of the fastener driving tool is characterized in that the control device is connected to an operating device for energy adjustment and/or to an indicator device that indicates energy information. With the aid of the operating device, a user or operator is able to set a desired amount of driving energy in a simple manner. With the aid of the indicator device, the desired amount of driving energy can be indicated in a simple manner. Additionally, a minimally and a maximally possible amount of driving energy can be indicated with the aid of the indicator device. As a result, the ease of use of the fastener driving tool is markedly increased.

The aforestated aim is alternatively or additionally achieved by a method for operating an aforedescribed fastener driving tool, in which method both the combustion chamber volume and metering of the fuel gas flow into the combustion chamber are adjusted with the aid of the control device. As a result, the amount of energy provided in the fastener driving tool for the purpose of driving fasteners can be adjusted very quickly and efficiently. As a result, it is made possible in particular to drive a variety of fasteners into a variety of substrates without energy being wasted. Owing to the adjustment of both, the combustion chamber volume and the amount of fuel gas fed in, the mixing ratio in the combustion chamber can be optimally adjusted.

A preferred embodiment of the method is characterized in that the current actual combustion chamber volume is measured and compared with a desired target combustion chamber volume. The setting for the combustion chamber volume may be stored in the control device.

Another preferred embodiment of the method is characterized in that a control variable for the adjusting device for adjusting the combustion chamber volume is determined from deviations between the current actual combustion chamber volume and the desired target combustion chamber volume. The target combustion chamber volume is provided by the user or operator. The control variable determined is used to control the motor, with the aid of which the combustion chamber volume is adjusted.

Another preferred embodiment of the method is characterized in that the fastener driving tool has a reset function which is triggered by a user interaction and during which the setting of the combustion chamber volume and/or metering of the fuel gas flow into the combustion chamber is/are calibrated. The reset function is triggered, for example, as a result of a rechargeable battery or gas cartridge being inserted into the fastener driving tool.

Another preferred embodiment of the method is characterized in that during a reset the adjusting device for adjusting the combustion chamber volume is moved against a limit stop. During a reset the motor is moved against a limit stop, for example. On reaching the limit stop, the motor remains in the position adopted, for example because further adjustment is blocked or the motor is switched off.

Another preferred embodiment of the method is characterized in that the current actual combustion chamber volume is measured with the aid of a sensor device. The required adjustment of the motor is determined through comparison with the desired target combustion chamber volume. A reset function for position determination is not needed in this embodiment.

Another preferred embodiment of the method is characterized in that the metering valve device is normally closed, and is opened for a predefined length of time by the control device, such that a specified amount of gas flows into the combustion chamber. The gas is taken, for example, from a gas cartridge that is exchangeably arranged in the fastener driving tool. The amount of gas may be modulated by varying the length of the opening time of the metering valve device.

Another preferred embodiment of the method is characterized in that a desired amount of driving energy, a minimally possible amount of driving energy, and/or a maximally possible amount of driving energy is indicated on the fastener driving tool. The particular amount of driving energy is indicated preferably with the aid of the aforedescribed indicator device.

Further advantages, features and details of the invention will become apparent from the following description, in which various embodiments are described in detail with reference to the drawing.

BRIEF DESCRIPTION OF THE DRAWING

FIG. 1 shows a simplified illustration of a fastener driving tool according to the invention in a sectional view, with an operating device.

DETAILED DESCRIPTION OF THE DRAWING

In FIG. 1, a fastener driving tool 1 according to the invention having a housing 2 is depicted greatly simplified in a longitudinal section. The housing 2 comprises a handle 4, by which the fastener driving tool 1 can be grasped for driving a fastener that exits from the fastener driving tool 1 at a muzzle end 5 and is capable of being driven into a substrate.

The energy required to drive the fastener into the substrate is provided, for example, in a gas cartridge 8 in the interior of the fastener driving tool 1. The gas cartridge 8 is connectable by an adjustable or controllable metering valve 10 to a combustion chamber 12. In the combustion chamber 12, gas from the gas cartridge 8 is mixed with air to form a combustible mixture, which is ignited in order to drive a fastener, such as a stud or a nail, into the substrate.

The combustion chamber 12 is enclosed in the interior of the housing 2 by a cylinder 14. On one side, in particular a rear side, of the cylinder 14, the combustion chamber is closed off by an adjustable combustion chamber wall 15. The combustion chamber wall 15 may be adjusted with the aid of an electric motor 16 by an actuating gear mechanism 17, as indicated by a double arrow 18. By adjusting the combustion chamber wall 15 in the direction of the double arrow 18, the size of the combustion chamber can be varied in a simple manner.

State parameters in the combustion chamber 12 and/or the position of the adjustable combustion chamber wall 15 can be measured with the aid of a sensor device 20. The sensor device 20 is connected by a sensor line 21 to an electric or electronic control device 25. The control device 25 is connected in control relationship by a control line 26 to the electric motor 16. The control device 25 is supplied with electric energy from an accumulator 28, such as a battery. The control device 25 is connected in control relationship by a further control line 29 to the metering valve 10.

The combustion chamber 12 is closed off on the side thereof opposite the adjustable combustion chamber wall 15, in particular on the front side, by a piston bottom 32 of a working piston 34. The working piston 34 is guided at one end with the piston bottom 32 in a cylinder and at the other end, the end thereof opposite the piston bottom 32, in a guide bush. The working piston 34 extends through a buffer device 38. The movement of the working piston 34 when driving a fastener is slowed down by the fastener and in the case of excess kinetic energy by the buffer device 38.

Driving a fastener is triggered by a trigger 42 which is capable of being actuated on the handle 4, for example with the index finger. In addition to the trigger 42, the fastener driving tool 1 according to the invention comprises an operating device 44 having an operating element 45.

In addition to the trigger 42 and the operating device 44, the fastener driving tool 1 according to the invention comprises an indicator device 55 for indicating energy information during operation of the fastener driving tool 1. The indicator device 55 is connected to the electric or electronic control device 25 and comprises, for example, a display whereby energy information can be indicated alphanumerically and/or graphically, for example by symbols. Alternatively or additionally, the indicator device 55 may have a color display.

The operating element 45 enables the user or operator of the fastener driving tool 1 to specify a target value for the driving energy. The specified target value and/or the desired application, for example "wood" for low amounts of energy, "concrete" for medium amounts of energy and "steel" for high amounts of energy, is indicated by the indicator device 55. Also indicated by the indicator device 55 are the maximally and the minimally possible driving energy that the fastener driving tool 1 is capable of delivering at the particular time. When overload or underload thresholds are reached, the user is warned by an indicator element of the indicator device 55, or by a signal tone.

During operation of the fastener driving tool 1, the combustion chamber volume and the required gas volume that correspond to a desired target amount of driving energy are determined with the aid of the control device 25, preferably factoring in ambient parameters, such as the ambient temperature and ambient pressure. The control device 25 emits signals to the electric motor 16 to set the desired combustion chamber volume.

The electric motor 16 is designed preferably in the form of a motor actuator and adjusts the combustion chamber wall 15 by the adjusting gear mechanism 17. The adjusting gear mechanism 17 is preferably designed such that a self-locking mechanism causes the same to remain in the current position thereof when under load from the combustion chamber pressure that acts on the adjusting gear mechanism 17 by the combustion chamber wall. Additionally, the adjusting gear mechanism 17 is preferably designed such that the combustion chamber pressure does not act on the electric motor 16.

The setting for the desired combustion chamber volume is stored in the electric control device 25. A control variable for the electric motor 16 with which the combustion chamber volume is adjusted by the adjusting gear mechanism 17 is determined from a deviation between a target value entered by the user and a stored or determined position value of the combustion chamber wall 15.

The fastener driving tool according to the invention has a reset function, during which the combustion chamber volume setting is recalibrated. The reset function is started, for example, by a user interaction. Inserting the accumulator 28 or the gas cartridge 8, for example, may lead to a reset. During the reset, the combustion chamber volume adjusting mechanism, for example the adjusting gear mechanism 17 or the combustion chamber wall 15, is moved against a limit stop.

Two different methods may be used for calibration. In the first method, the electric motor 16 may be moved securely against a limit stop, using a sufficiently large number of steps. On reaching the limit stop, the electric motor 16 continues to remain under load, but adjusting is blocked. As a result, the electric motor 16 remains in the limit-stop position thereof. Alternatively, it is possible to measure a voltage-current characteristic of the electric motor 16. The change in the voltage-current characteristic on reaching the limit stop causes the electric motor 16 to be switched off.

According to a further embodiment the current actual combustion chamber volume is measured with the aid of the sensor 20. A required adjustment of the combustion chamber wall 15 with the aid of the electric motor 16 by the adjusting gear mechanism 17 can be determined through comparison with the desired target combustion chamber value. When the sensor 20 is used, the aforedescribed reset function is not needed.

The metering valve 10 is preferably electrically actuated and is pre-stressed in the closed position thereof. During operation of the fastener driving tool 1, the metering valve 10 is controlled by the control device 25 and is opened for a predetermined length of time. When the metering valve 10 is open, gas can flow from the gas cartridge 8 into the combustion chamber 12. The amount of gas may be modulated by varying the opening time.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A fastener driving tool for driving fasteners into a substrate, comprising:

a working piston;

a combustion chamber, wherein the working piston is drivable by the combustion chamber and wherein the combustion chamber includes an adjustable combustion chamber wall such that a volume of the combustion chamber is adjustable;

an adjusting device, wherein the adjustable combustion chamber wall is linearly adjustable by the adjusting device;

a metering valve device, wherein a fuel gas providable to the combustion chamber is meterable by the metering valve device; and a control device, wherein the adjusting device and the metering valve device are controllable by the control device, wherein a combustion chamber volume that corresponds to a desired target amount of driving energy is determinable by the control device, and wherein the volume of the combustion chamber is adjustable to a determined combustion chamber volume by the control device.

2. The fastener driving tool according to claim 1, wherein the adjusting device includes a motor.

3. The fastener driving tool according to claim 2, wherein the motor is linked by a gear mechanism to the adjustable combustion chamber wall.

4. The fastener driving tool according to claim 1, further comprising an energy adjustment operating device and an energy indicator device, wherein the energy adjustment operating device and the energy indicator device are controllable by the control device.

5. A method for operating a fastener driving tool, comprising the steps of:

adjusting a volume of a combustion chamber by a control device adjusting a combustion chamber wall of the combustion chamber, wherein a combustion chamber volume that corresponds to a desired target amount of driving energy is determined by the control device and wherein the volume of the combustion chamber is adjusted to the determined combustion chamber volume by the control device; and metering of a flow of a fuel gas into the combustion chamber by the control device.

6. The method according to claim 5, further comprising the steps of measuring the combustion chamber volume and comparing the measured combustion chamber volume with the determined combustion chamber volume.

7. The method according to claim 6, further comprising the step of determining a control variable from a deviation between the measured combustion chamber volume and the determined combustion chamber volume.

8. The method according to claim 5, further comprising the steps of triggering a reset of the fastener driving tool and, during the reset, calibrating a setting of the combustion chamber volume and/or a metering of the fuel gas flow into the combustion chamber.

9. The method according to claim 8, further comprising the step of, during the reset, moving an adjusting device for adjusting the volume of the combustion chamber against a limit stop.

10. The method according to claim 5, further comprising the step of measuring the volume of the combustion chamber by a sensor device.

11. The method according to claim 5, wherein the step of metering includes the step of opening a normally closed metering valve device for a predefined length of time by the control device such that a specified amount of fuel gas flows into the combustion chamber.

12. The method according to claim 5, further comprising the step of indicating the desired target amount of driving energy, a minimally possible amount of driving energy, and/or a maximally possible amount of driving energy on the fastener driving tool.

13. The method according to claim 5, further comprising the step of determining a required gas volume that corresponds to the desired target amount of driving energy by the control device.

* * * * *